US009466414B2

(12) United States Patent
Cooper et al.

(10) Patent No.: US 9,466,414 B2
(45) Date of Patent: Oct. 11, 2016

(54) VIBRATION STABILIZER FOR ENCLOSURE COOLING FINS

(71) Applicant: Cooper Technologies Company, Houston, TX (US)

(72) Inventors: Jeramie Allen Cooper, Lannon, WI (US); Scott Liston Bunyer, Pewaukee, WI (US); Nole Thomas Martin, Pewaukee, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/629,611

(22) Filed: Feb. 24, 2015

(65) Prior Publication Data

US 2016/0247619 A1 Aug. 25, 2016

(51) Int. Cl.

| | |
|---|---|
| ***H01F 27/10*** | (2006.01) |
| ***H01F 27/08*** | (2006.01) |
| ***F24D 3/16*** | (2006.01) |
| ***F28D 15/00*** | (2006.01) |
| ***H01F 27/02*** | (2006.01) |

(52) U.S. Cl.

CPC ..... *H01F 27/08* (2013.01); *H01F 27/02* (2013.01)

(58) Field of Classification Search

CPC .. H01F 27/2876; H01F 27/33; H01F 27/027; F24D 3/16

USPC ..... 336/58, 55, 57, 60, 94; 165/56, 104.33

See application file for complete search history.

(56) References Cited

U.S. PATENT DOCUMENTS

| | | | | |
|---|---|---|---|---|
| 4,413,674 | A * | 11/1983 | Avery | H01F 27/12 165/104.33 |
| 4,549,603 | A * | 10/1985 | Shirai | F28D 1/0316 165/104.33 |
| 6,050,329 | A | 4/2000 | Durian et al. | |
| 7,032,650 | B1 | 4/2006 | Tian | |
| 7,506,683 | B2 | 3/2009 | Hu | |
| 8,461,953 | B1 * | 6/2013 | Ward | H01F 27/08 336/55 |
| 2001/0032718 | A1 | 10/2001 | Sheerin et al. | |
| 2013/0043965 | A1 * | 2/2013 | Devaux | H01F 27/33 336/94 |
| 2013/0058070 | A1 * | 3/2013 | Gaard | H01F 27/025 361/836 |

FOREIGN PATENT DOCUMENTS

| | | | |
|---|---|---|---|
| JP | 08-162333 | A | 6/1996 |
| KR | 10-1999-0039364 | A | 6/1999 |

OTHER PUBLICATIONS

PCT International Search Report and Written Opinion from corresponding PCT/US2016/018196, May 27, 2016.

* cited by examiner

*Primary Examiner* — Mangtin Lian
*Assistant Examiner* — Kazi Hossain
(74) *Attorney, Agent, or Firm* — Ziolkowski Patent Solutions Group, SC

(57) ABSTRACT

An enclosure for an electrical apparatus includes a tank having a bank of corrugate affixed to one or more walls thereof, with the bank of corrugate including a plurality of cooling fins in fluid communication with a volume of the tank via a plurality of openings formed in the walls, such that cooling fluid can flow into the cooling fins. A cross member is affixed to the bank of corrugate along each of a top surface and a bottom surface thereof and extends along a length of the corrugate at a distal end of the cooling fins. Vibration stabilizers are provided to control vibrations in the corrugate bank, with the vibration stabilizer having a gusset plate joined to the cross member and extending between a pair of adjacent cooling fins and stabilizer with a first end attached to the tank and a second end attached to the gusset plate.

20 Claims, 6 Drawing Sheets

VIBRATION STABILIZER FOR ENCLOSURE COOLING FINS

BACKGROUND

Embodiments of the present invention relate generally to power system enclosures, and, more particularly, to a corrugated enclosure that includes vibration stabilizers thereon to reduce the vibration of cooling fins of the enclosure during transport.

Transformers, and similar devices, come in many different shapes and sizes for many different applications and uses. Fundamentally, all of these devices include at least one primary winding(s) with at least one core path(s) and at least one secondary winding(s) wrapped around the core(s). When a varying current (input) is passed through the primary winding a magnetic field is created which induces a varying magnetic flux in the core. The core is typically a highly magnetically permeable material which provides a path for this magnetic flux to pass through the secondary winding thereby inducing a voltage on the secondary (output) of the device.

Power transformers are employed within power distribution systems in order to transform voltage to a desired level and are sized by the current requirements of their connected load. If a load is connected to the secondary, an electric current will flow in the secondary winding and electrical energy will be transferred from the primary circuit, through the transformer, to the load. Transformers are designated by their power rating, typically in kVA, which describes the amount of energy per second that they can transfer and also by their primary and secondary operating voltages, typically in kV. Medium power transformers can be rated up to 10,000 kVA and up to 46 kV while large power transformers can be rated up to 120,000 kVA and up to 345 kV.

One shortcoming of existing transformers is their susceptibility to operational problems associated with high temperatures of operation, both internal and external to the transformer. The largest source of heat in a transformer is heat created by the load current flowing through windings of the core-winding assembly, based on the inherent resistance of the wire from which the windings are constructed. High temperatures for long periods of time in transformers will destroy insulation positioned about and between the windings, thereby leading to a transformer failure. During the design of power transformers, considerable effort is spent to: reduce losses so as to decrease the generation of heat in the windings; move heat away from the windings (i.e., provide cooling) and spread the heat out by physical design (i.e., provide heat dissipation); and improve the winding insulation so that it can withstand greater exposure to heat.

With regard to providing cooling to the transformer windings and heat dissipation from the transformer, one common solution is to construct the transformer as a liquid-filled transformer. In a typical liquid-filled power transformer, a bath of dielectric insulating liquid is contained within the enclosure/tank of the transformer, with the core and windings of the transformer being submerged in the dielectric insulating liquid. Moving heat away from the windings is accomplished by direct contact of the windings with the dielectric insulating liquid. The denser the dielectric insulating liquid the better the heat transfer and, as such, the typical liquids used are selected both for their dielectric properties (insulating the high voltage) as well as their heat transfer properties.

In operation of a liquid-filled transformer, it is recognized that as heat is moved away from the windings and transferred to the dielectric fluid, a heat-exchanging mechanism for dissipating heat in the dielectric fluid is required. One existing type of heat-exchanging mechanism that is typically utilized is a bank of corrugate that is attached to the enclosure. The enclosure is constructed to include a corrugate bank on one or more sides thereof—with each corrugate bank being formed from a plurality of cooling fins. The cooling fins provide the dielectric insulating liquid a path to circulate through a region of increased surface area for the purpose of liquid-to-air heat exchange to cool the dielectric insulating liquid. The cooling fins, through convection, move the hot liquid through a channel formed in each fin, therefore providing more surface area for the air outside of the enclosure to contact the cooling fins to remove heat from the liquid.

While the corrugated enclosure functions to provide effective cooling for the transformer during operation, it is recognized that the structure of the enclosure provides challenges with respect to shipping and delivery of the enclosure to an end-use site. That is, during shipping of the enclosure, shipping vibrations and wind loads on the corrugate bank may lead to cracks at a weld between a cross-rod that runs along the length of the corrugate bank and lead to cracks where the respective cooling fins are joined to the enclosure tank—i.e., a "triple point."

To address these shipping vibrations present in the corrugated enclosure, stabilizer rods have been utilized in order to minimize such vibrations. One existing use of such stabilizer rods includes placement of a single ¼ inch stabilizer rod at each of the corners of the corrugate bank, with the stabilizer rod extending out from the tank wall and being joined to the corrugate cross-rod at a location between the two outermost fins of the corrugate bank. While these single stabilizer rods are effective in preventing cracks at a weld between the corrugate cross-rod and respective cooling fins, the stabilizer rods undesirably channel more forces down the outermost cooling fin—which can lead to leaks at the base of that fin where it joins to the tank. In addition, long cross country trips with a long vibration duration can lead to leaks at the cross-rod and corrugate cooling fin.

Therefore, it would be desirable to provide a vibration stabilizer that reduces the level of vibration of cooling fins of a corrugate enclosure during transport. Such a vibration stabilizer would reduce the effect of vibration on the welds between the cross-rod and the cooling fins, while also reducing the amount of force channeled down the outermost cooling fins, so as to prevent leaks at the base of an outermost fin where it joins to the tank.

BRIEF DESCRIPTION

In accordance with one aspect of the present invention, an enclosure for an electrical apparatus includes a tank having a plurality of walls that define a tank volume capable of containing a cooling fluid therein, with one or more of the plurality of walls including openings formed therein that provide an inlet and outlet for the cooling fluid. The enclosure also includes a bank of corrugate affixed to each of the one or more of the plurality of walls that include the openings formed therein, the bank of corrugate comprising a plurality of cooling fins in fluid communication with the tank volume via the plurality of openings such that cooling fluid can flow into the plurality of cooling fins, as well as a cross member affixed to the bank of corrugate along each of a top surface and a bottom surface of the bank of corrugate, at an end of the cooling fins distal from the tank, with each cross member extending along a length of the bank of corrugate. The enclosure further includes one or more vibration stabilizers to control vibrations in the corrugate bank, each of the one or more vibration stabilizers having a gusset plate joined to the cross member and extending between a pair of adjacent cooling fins and a plurality of stabilizer members each comprising a first end and a second end, wherein the first end of each of the plurality of stabilizer members is attached to the tank and the second end of each of the plurality of stabilizer members is attached to the gusset plate.

In accordance with another aspect of the present invention, a corrugated enclosure includes a tank, a bank of corrugate affixed to one or more walls of the tank and that includes comprising a plurality of cooling fins, a cross member affixed to the bank of corrugate at an end of the cooling fins distal from the tank and along each of a top surface and a bottom surface of the bank of corrugate, and a plurality of vibration stabilizers to control vibrations in the bank of corrugate. Each vibration stabilizer further includes a gusset plate joined to the cross member and extending between a pair of adjacent cooling fins and a pair of stabilizer members attached to the tank and the gusset plate so as to be in a V-shaped arrangement.

In accordance with yet another aspect of the present invention, a transformer includes a tank, a core-winding assembly positioned within the tank and including a transformer core and a plurality of windings wound about the transformer core, and a transformer fluid contained within the tank and immersing the core-winding assembly. The transformer also includes a corrugate bank comprising a plurality of cooling fins that are formed on one or more walls of the tank, with a cross member affixed to the bank of corrugate at an end of the cooling fins distal from the tank and along each of a top surface and a bottom surface of the bank of corrugate. The transformer further includes a plurality of vibration stabilizers to control vibrations in the corrugate bank, with each vibration stabilizer having a gusset plate joined to the cross member and extending between a pair of adjacent cooling fins of the plurality of cooling fins and a pair of stabilizer members attached to the tank on a first end of the stabilizer members and attached to the gusset plate on a second end of the stabilizer members, the pair of stabilizer members being in a V-shaped arrangement.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention are directed to power system enclosures, and, more particularly, to a corrugated enclosure having vibration stabilizer rods thereon to reduce the vibration of cooling fins of the enclosure during transport. While an operating environment of an exemplary embodiment of such an enclosure is described below with respect to a three-phase liquid-filled transformer, it is recognized embodiments of the invention are not limited to such an implementation. That is, it is recognized that embodiments of the invention are not to be limited to the specific transformer configurations set forth in detail below and that all single-phase and three-phase transformers and voltage regulators are recognized to fall within the scope of the invention. According to additional embodiments, power system enclosures may be utilized with medium power transformers as well as large power, substation, solar power, generator step-up, auxiliary, auto, and grounding transformers, for example.

Figure 1:
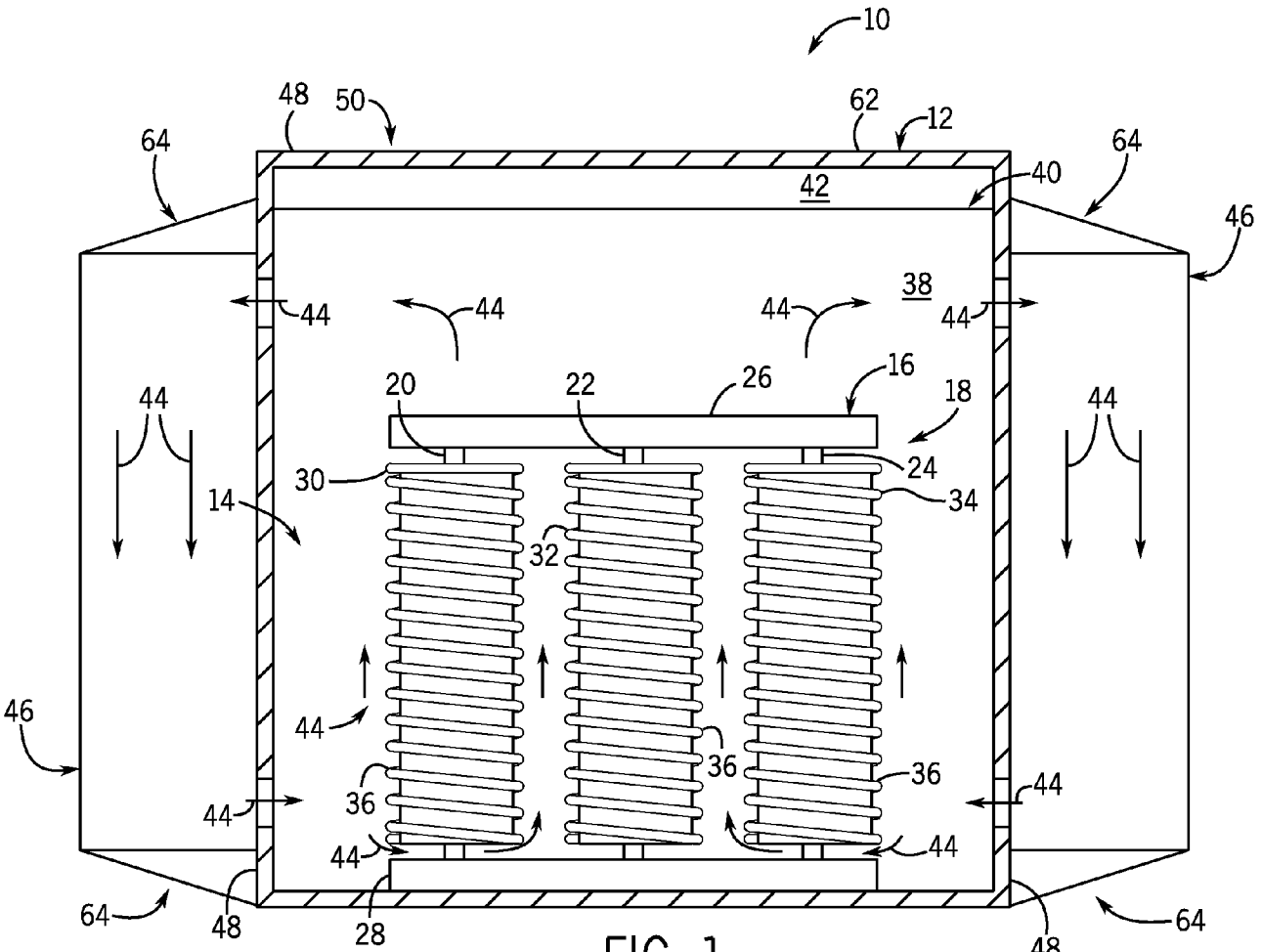
FIG. 1 is a schematic view of a liquid-filled transformer in which embodiments of the invention may be implemented.

Referring to FIG. 1, a power transformer 10 is shown in which embodiments of the invention may be incorporated. The transformer 10 includes a metallic enclosure 12 in which is disposed a core-winding assembly 14 formed of a magnetic core 16 with windings 18 there-around. According to an embodiment of the invention, magnetic core-winding assembly 14 includes a three phase magnetic core 16 having, for example, winding legs 20, 22, 24 connected by upper and lower yoke portions 26, 28, respectively. Magnetic core 16 can be formed of a plurality of stacks of magnetic, metallic laminations (not shown), such as grain-oriented silicon steel, for example. While transformer 10 is shown as including a three phase magnetic core 16, it is recognized that transformer 10 could also be configured as a single-phase transformer or a voltage regulator.

The windings 18 include winding assemblies 30, 32, 34, disposed about winding legs 20, 22, 24, respectively. Each of the phase winding assemblies 30, 32, 34 is composed of a set of primary and secondary windings, with the sets of primary and secondary windings being connected in any known type of multiphase configuration. The windings 18 are formed from strips of electrically conductive material such as copper or aluminum and can be rectangular or round in shape, for example, although other materials and shapes may also be suitable. Individual turns of windings 18 are electrically insulated from each other by cellulose insulating paper 36 (i.e., "Kraft paper") to ensure that current travels throughout every winding turn and to protect the windings 18 from the high electrical and physical stresses present in the transformer.

As shown in FIG. 1, transformer 10 is configured as a liquid-filled transformer in that the core 16 and windings 18 are immersed in a bath of transformer fluid 38 (i.e., cooling fluid) that both cools and electrically insulates the windings 18. That is, cooling fluid 38 is a dielectric fluid that also exhibits desirable cooling properties. According to an exemplary embodiment, the cooling fluid 38 is in the form of an oil-based fluid having a high fire point (i.e., a less-flammable fluid). The cooling fluid 38 could be in form of a seed-, vegetable-, bio-, or natural ester-based oil or a silicone-based oil or synthetic hydrocarbon, that remains stable at transformer operating temperature conditions and provides superior heat transfer capabilities. It is also recognized, however, that other dielectric fluids could be utilized having suitable insulating and cooling properties, such as fluorinated hydrocarbons, for example, or any other dielectric fluid that exhibits desirable stability and heat transfer capabilities.

The enclosure 12 of transformer 10 is filled to a level 40 with the cooling fluid 38, with a nitrogen gas blanket 42 at the top of the internal volume of the transformer enclosure 12 used to maintain the dielectric quality of the fluid within the enclosure. In accordance with FIG. 3, a circulation flow path 44 is defined within the enclosure 12 according to which cooling fluid 38 is circulated across and through the windings 18 and within the enclosure 12. Cooling fluid 38 is circulated within enclosure 12, in part, according to natural convection flow, which relies on changes in fluid density to naturally create circulation flow. That is, during operation of transformer 10 the cooling fluid 38 about core 16 and windings 18 heats up, thereby forcing it to rise upward, as indicated by arrows 44. Once the cooling fluid 38 exits flow channels defined by windings 18, the heated fluid rises toward the top of the fluid level in enclosure 12. Subsequent cooling of the heated cooling fluid 38 by one or more banks of corrugate 46, as explained in detail below, then causes cooled dielectric fluid 38 to sink toward a lower portion of enclosure 12 by natural convection, again indicated by arrows 44, thereby allowing for re-circulation of cooled fluid across and through windings 18 and core 16 to repeat the process. Thus, natural convection flow circulates cooling fluid 38 generally along circulation flow path 44, although it is recognized that the natural convection flow may be somewhat less definitive in certain locations, and that the transformer 10 may also utilize pumps, impellers, or propellers (not shown) within enclosure 12 to push and direct the cooling fluid 38 through the core-winding assembly 14 according to a forced convection flow.

As indicated above, one or more banks of corrugate 46 are provided on and as part of the enclosure 12—such that the enclosure 12 may be described as a "corrugated enclosure"—to provide for enhanced cooling of the cooling fluid 38. That is, enclosure 12 is formed of a plurality of walls 48 that generally define a tank body 50 that provides a volume in which the cooling fluid 38 is contained/stored, with a bank of corrugate 46 being formed on one or more of these walls 48—such as on each of the four side walls 48 of the tank 50 includes a bank of corrugate 46 thereon. According to an exemplary embodiment, the banks of corrugate are composed of 16 gauge metal, although it is recognized that metal of a different gauge (e.g., 12 gauge) could also be used to form the corrugate.

Figure 2:
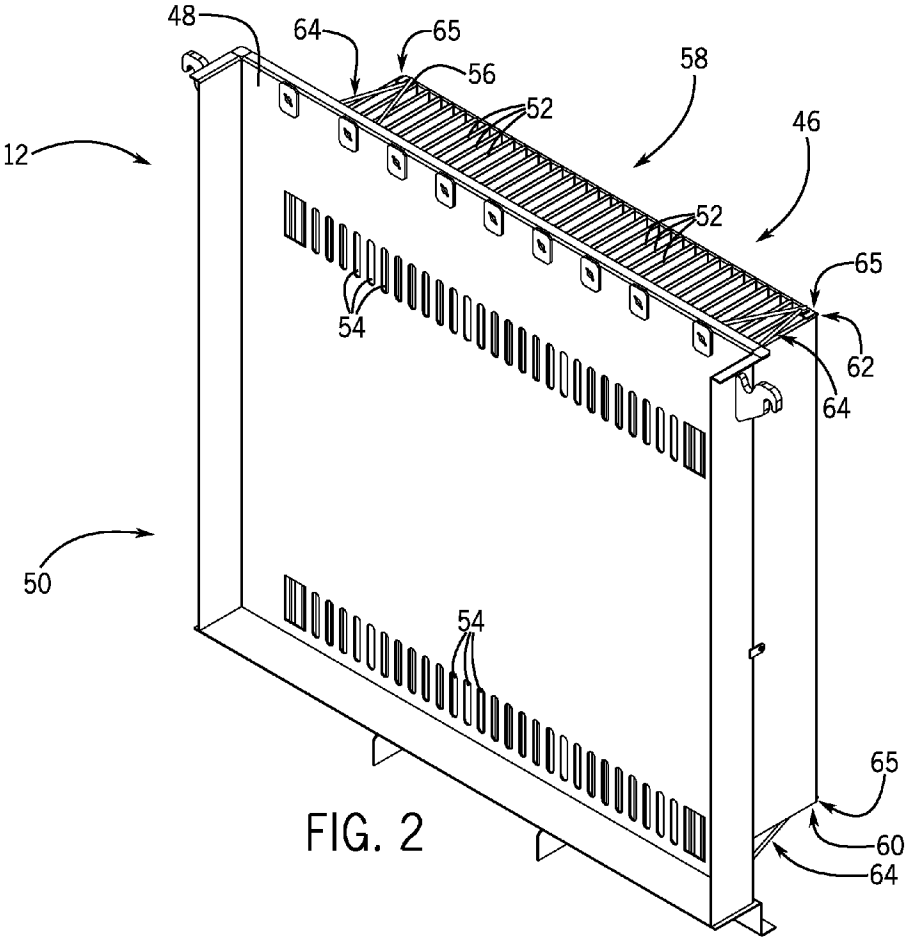
FIGS. 2 and 3 are perspective views of a portion of a corrugated enclosure, according to an embodiment of the invention.
Figure 3:
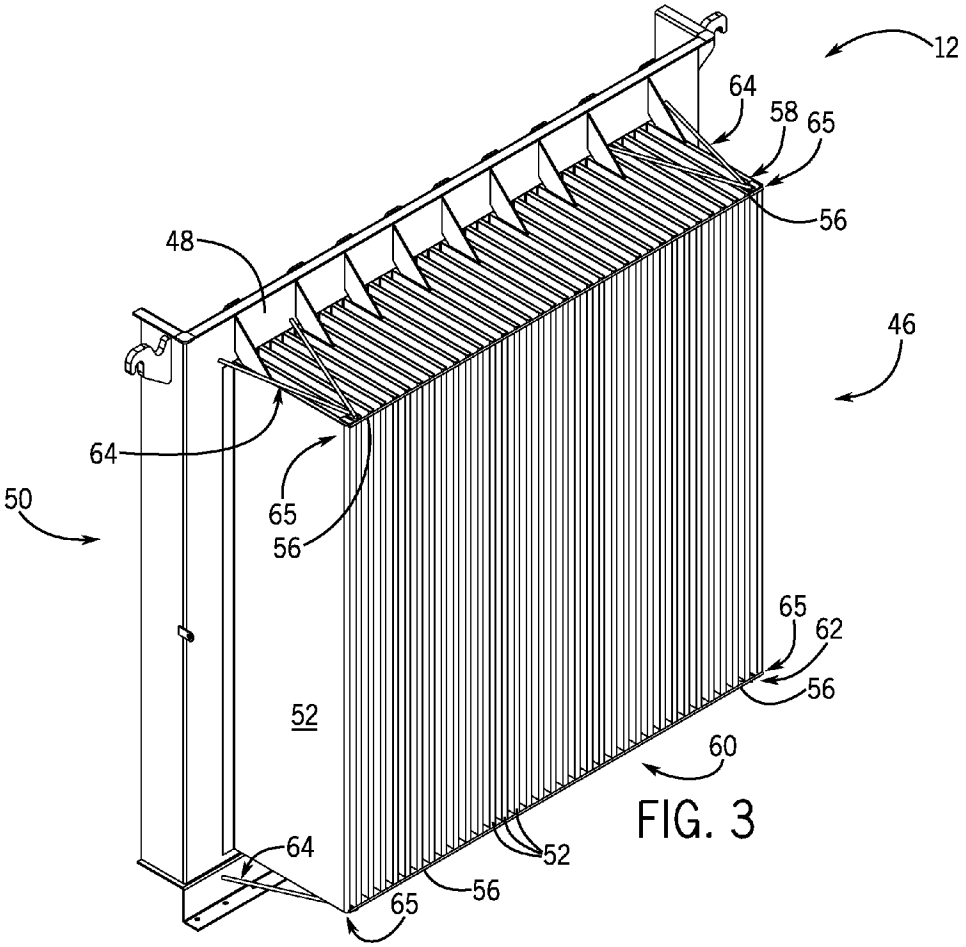

Referring now to FIGS. 2 and 3, and with continued reference to FIG. 1, partial views of the enclosure 12 are shown to further illustrate the construction of the tank 50 and the banks of corrugate 46. As shown in FIGS. 2 and 3, each bank of corrugate 46 is formed of a plurality of cooling fins 52 that are welded to a wall 48 of tank 50 and spaced apart from one another a desired distance. Each of the cooling fins 52 has a hollow or semi-hollow construction, such that cooling fluid 38 can be circulated therethrough from the tank 50—with the cooling fins 52 being in fluid communication with the tank 50 via a plurality of openings 54 formed in the wall 48 of the tank 50 (FIG. 2) that provide an inlet and outlet for the cooling fluid 38 to enter and exit the cooling fins 52. The number and sizing of the cooling fins 52 can vary based on the type of the transformer 10 and the size of the enclosure 12, but according to one embodiment, a bank of corrugate 46 on a back wall 48 of the tank 50 may include 35 cooling fins 52 each having a height of 65 inches, for example. The cooling fins 52 provide the cooling fluid 38 a path to circulate through a region of increased surface area for the purpose of liquid-to-air heat exchange to cool the cooling fluid 38. The cooling fins 52, through convection, move the hot fluid 38 therethrough, providing more surface area for the air outside of the enclosure 12 to contact the cooling fins 52 to remove heat from the cooling fluid 38.

As best shown in FIG. 3, a cross member 56 is affixed to (e.g., formed integrally with) the bank of corrugate 46 along each of a top surface 58 and a bottom surface 60 thereof that provides strength to the bank of corrugate. More specifically, a cross member 56 is positioned at an end 62 of the cooling fins 52 distal from the tank 50, at each of a top and bottom edge of the cooling fins 52, with each cross member 56 extending along a length of the bank of corrugate 46. In an exemplary embodiment, the cross member 56 are formed as cross bars of suitable diameter (e.g., ¼ inch bars) formed on the cooling fins 52. It is recognized, however, that the shape/dimensions of the cross member 56 is a function of how the corrugate 46 is manufactured—i.e., is a byproduct of the machine that is used to make the corrugate—and that the cross member could come in any of a number of forms. Thus, while the cross member is hereafter referred to as a cross rod, it is recognized that the cross member could take the form of any of a bar, angle, or member of another geometry, that performs the same function as the rod, and that the exact geometry would be at least in part a result of the machine used to manufacture the corrugate 46.

Also affixed to the bank of corrugate 46 and to the tank 50 are a number of vibration stabilizers 64 that function to reduce the level of vibration experienced by the cooling fins 52 during transport of the enclosure 12 (and transformer 10) to a destination of end use. The vibration stabilizers 64 reduce the effect of vibration on the welds between the cross-rod and the cooling fins 52 and on the welds between the cooling fins 52 and the tank wall 48. The vibration stabilizers 64 therefore reduce the amount of force channeled down a number of the cooling fins of the corrugate bank 46, so as to prevent leaks at the base of a fin 52 where it joins to the tank 50. In an exemplary embodiment, a vibration stabilizer 64 is positioned proximate each of the four corners 65 of the bank of corrugate 46, so as maximize the amount of vibration reduction provided to the bank of corrugate 46. It is recognized, however, a vibration stabilizer 64 could only be provided at any location on the bank of corrugate 46—such as at just the upper corners or the lower corners of the bank of corrugate 46, or at more central locations along a length of the bank of corrugate 46, according to additional embodiments.

Figure 4:
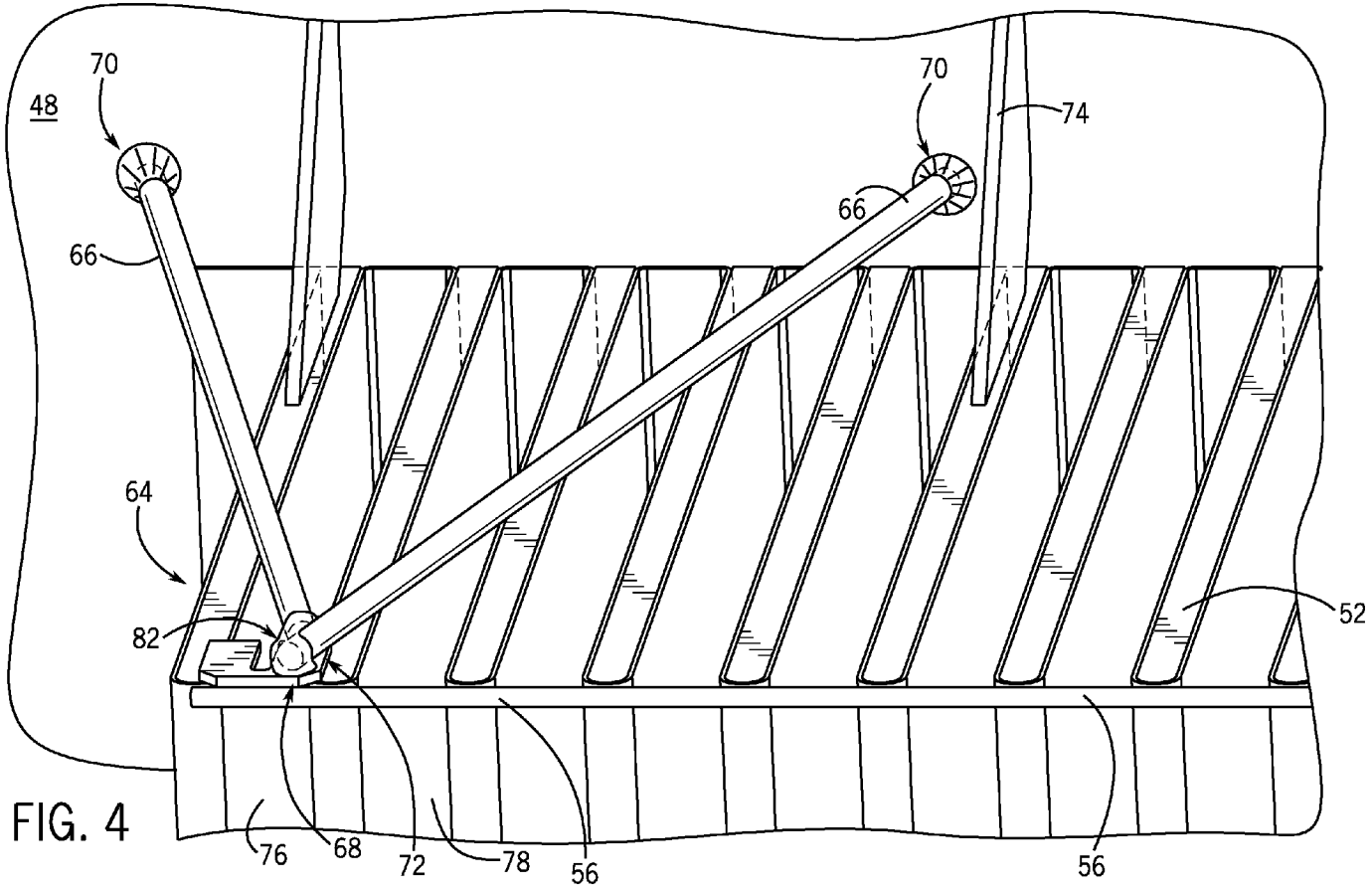
FIG. 4 is a detailed view of a vibration stabilizer provided on the corrugated enclosure of FIGS. 2 and 3, according to an embodiment of the invention.

As shown in FIGS. 2 and 3 and also now in FIG. 4, each vibration stabilizer 64 is formed from a pair of stabilizer members 66 and a gusset plate 68. The gusset plate 68 is in the form of a flat plate that is welded to the cross rod 56 and extends between a pair of adjacent cooling fins 52, such as between fins proximate a respective corner 65 of the bank of corrugate 46. According to an exemplary embodiment, the pair of stabilizer members 66 are formed as stabilizer rods of suitable diameter (e.g., diameter of ⅜ inches), however, it is recognized that the stabilizer members could take the form of any of a number of suitable shapes. Accordingly, while the stabilizer members are hereafter referred to as stabilizer rods, it is recognized that the stabilizer members could take the form of a square bar, round or square tube, angle, or member of another geometry. The stabilizer rods 66 extend between the gusset plate 68 and the wall of the tank 50, with a first end 70 of each of the stabilizer rods 66 being attached to the tank 50 and a second end 72 of each of the stabilizer rods 66 being attached to the gusset plate 68. In an exemplary embodiment, the stabilizer rods 66 are welded to the tank 50 and the gusset plate 68 to secure them thereto, but it is recognized that the stabilizer rods 66 may be configured as removable rods that attach to the tank 50 and the gusset plate 68 in a fashion that allows easy removal thereof, such as via bolts or screws.

In an exemplary embodiment, the pair of stabilizer rods 66 is attached to the tank 50 and the gusset plate 68 so as to be in a V-shaped arrangement—with the first end 70 of each of the stabilizer rods 66 being welded to the tank 50 at different locations and the second end 72 of each of the stabilizer rods 66 being welded to a common point on the gusset plate 68. Also in an exemplary embodiment, the first end 70 of each of the stabilizer rods 66 is welded to the tank 50 such that the rods 66 are a same distance above the top surface of the bank of corrugate 46 or below the bottom surface of the bank of corrugate 46 (depending on whether the vibration stabilizer 64 is at a top or bottom corner 65 of the corrugate bank), such as being at a location near a large gusset 74 on the tank 50 and at a location near a side edge of the corrugate 46, for example.

As best shown in FIG. 4, according to an exemplary embodiment, the gusset plate 68 is positioned between an outermost cooling fin (identified as 76) and a second outermost cooling fin (identified as 78) of the bank of corrugate 46, as shown best in FIG. 4. The second end 72 of each of the plurality of stabilizer rods 66 is affixed to the gusset plate 68 at a location adjacent the second outermost fin 78. By affixing the stabilizer rods 66 to the gusset plate 68 at this location adjacent the second outermost fin 78, a portion of vibrational forces experienced by the outermost fin 76 is transferred to the second outermost fin 78. This transfer of a portion of forces from the outermost fin 76 to the second outermost fin 78 lowers the level of force on the outermost fin to an acceptable level, while not raising the level of force on the second outermost fin to an unacceptable level.

Figure 5:
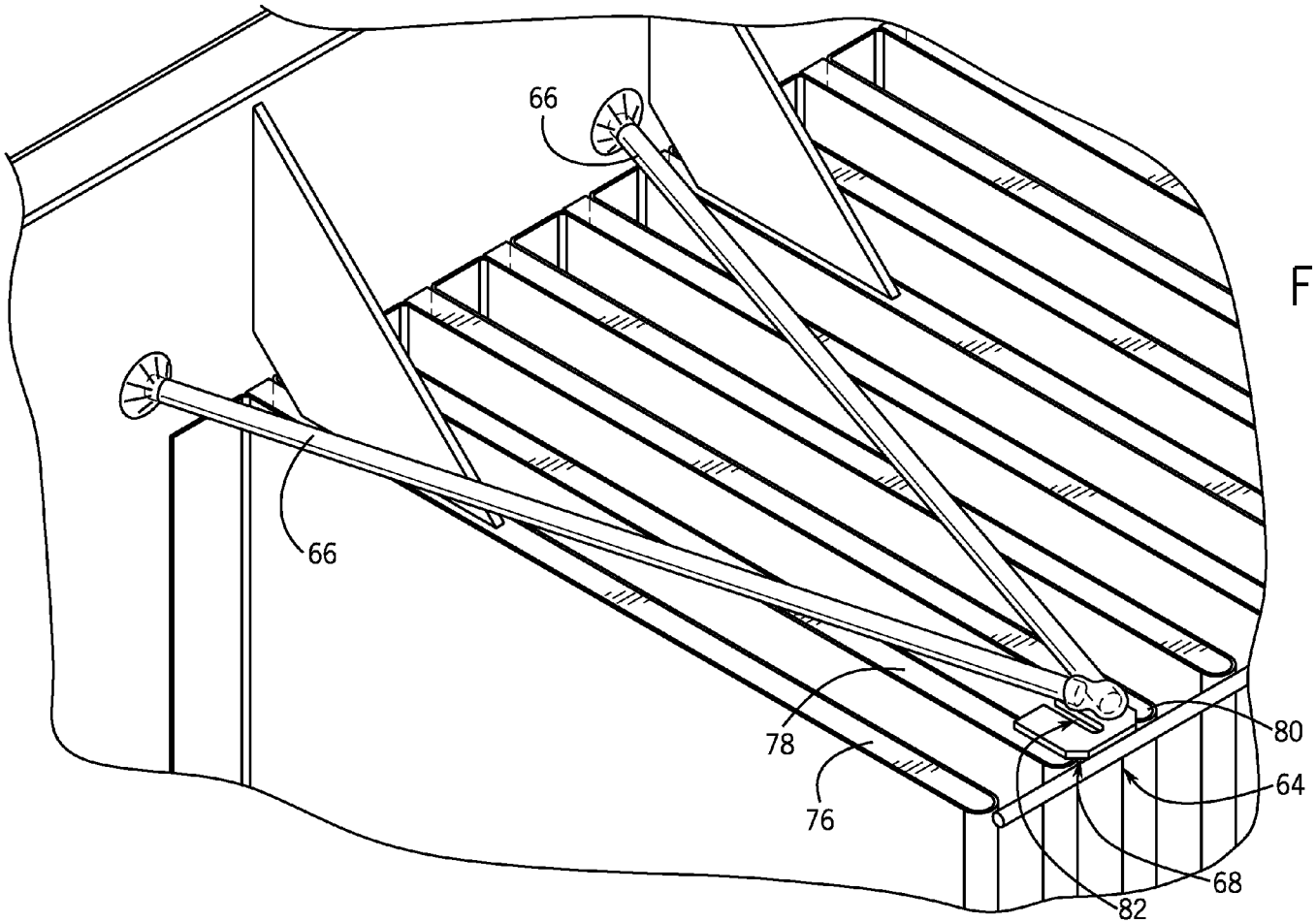
FIG. 5 is a detailed view of a vibration stabilizer provided on the corrugated enclosure of FIGS. 2 and 3, according to an embodiment of the invention.

While FIG. 4 illustrates the gusset plate 68 being positioned between an outermost fin 76 and a second outermost fin 78 of the bank of corrugate 46, it is recognized that the gusset plate 68 could be positioned further inward on the bank of corrugate 46 while still providing stress reduction to the cooling fins 52. For example, the gusset plate 68 could instead be positioned between the second outermost fin and the third outermost fin 80 (as shown in FIG. 5) or be placed even further inward, according to other embodiments.

Figure 6:
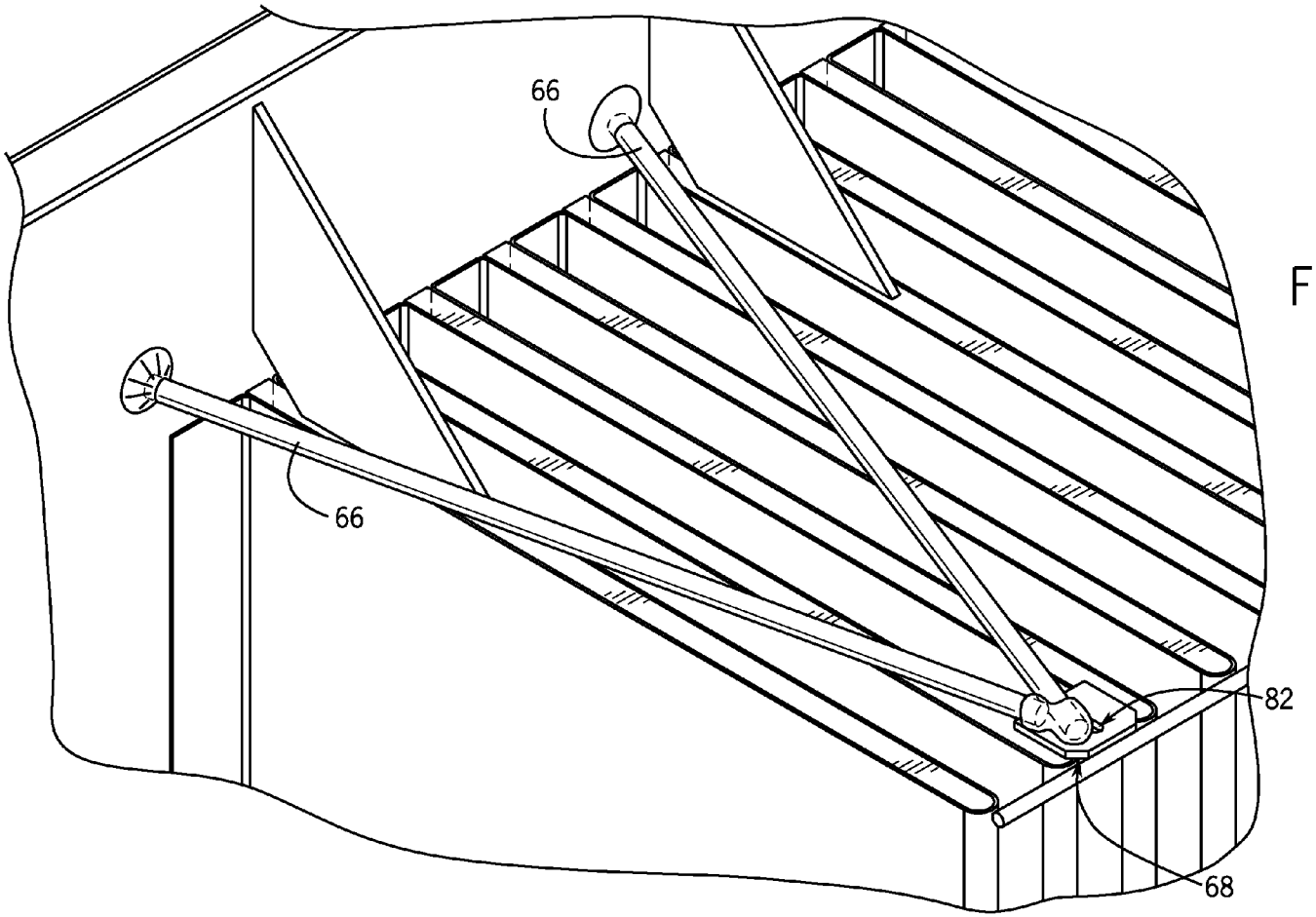
FIG. 6 is a detailed view of a vibration stabilizer provided on the corrugated enclosure of FIGS. 2 and 3, according to an embodiment of the invention.

Referring again now to FIG. 4, in an exemplary embodiment, the gusset plate 68 is formed to include a slot or notch 82 therein in/along an edge of the gusset plate 68 opposite an edge that is joined to the cross rod 56, so as to provide a gusset plate 68 with increased flexibility. The stabilizer rods 66 are affixed to the gusset plate 68 at a location inwardly spaced from the slot 82, i.e., toward a center of the bank of corrugate 46. Thus, as indicated above, in an embodiment where the gusset plate 68 is positioned between an outermost fin 76 and a second outermost fin 78 of the bank of corrugate 46, the stabilizer rods 66 are welded to the gusset plate 68 at a location inwardly spaced from the slot 82, such that the rods 66 are affixed to the gusset plate 68 adjacent the second outermost fin 78. It is recognized, however, that the stabilizer rods 66 could alternatively be welded to the gusset plate 68 at a location outwardly spaced from the slot 82, such that the stabilizer rods 66 are affixed to the gusset plate 68 adjacent the outermost fin 76, as shown in FIG. 6.

The inclusion of the slot 82 in the gusset plate 68 provided for increased levels of stress reduction on the adjacent fins 52 as compared to if the gusset plate 68 is formed without the slot 82. For example, in accordance with construction of one exemplary bank of corrugate 46, stress levels of 65 K psi would be experienced by the outermost fin 76 and second outermost fin 78, when a gusset plate 68 with no slot is provided between the outermost fin and second outermost fin, while stress levels of 58 K psi and 38 K psi would be experienced by the outermost fin 76 and second outermost fin 78, respectively, when a gusset plate 68 with a slot 82 is provided between the outermost fin and second outermost fin. Accordingly, it is seen that providing of a gusset plate 68 with a slot 82 formed therein functions to keep the stresses on the corrugate cooling fins 52 low during transport and during pressure changes in the tank 50.

Beneficially, embodiments of the invention provide vibration stabilizers for power system enclosures that function to reduce the vibration of cooling fins of the enclosure during transport. The vibration stabilizers reduce the effect of vibration on the welds between the cross-rod and the cooling fins, while also reducing the amount of force channeled down the outermost cooling fins, so as to prevent leaks at a triple point—where the base of a cooling fin joins to the enclosure tank. The use of two stabilizer rods in each vibration stabilizer, with the rods being set to the same distance above or below the cooing fins of the corrugate bank, reduces any coupling that would normally occur with using one rod, while the use of the gusset plate between cooling fins reduces the stress at the end of the cooling fins and allows for easier mounting of the stabilizer rods onto the fins and the cross rod. Furthermore, utilization of the vibration stabilizers allows for large banks of 16 gauge corrugate to replace radiators on solar power applications, therefore decreasing the unit cost, decreasing leaks and increasing value in such applications.

Therefore, according to an embodiment of the invention, an enclosure for an electrical apparatus includes a tank having a plurality of walls that define a tank volume capable of containing a cooling fluid therein, with one or more of the plurality of walls including openings formed therein that provide an inlet and outlet for the cooling fluid. The enclosure also includes a bank of corrugate affixed to each of the one or more of the plurality of walls that include the openings formed therein, the bank of corrugate comprising a plurality of cooling fins in fluid communication with the tank volume via the plurality of openings such that cooling fluid can flow into the plurality of cooling fins, as well as a cross member affixed to the bank of corrugate along each of a top surface and a bottom surface of the bank of corrugate, at an end of the cooling fins distal from the tank, with each cross member extending along a length of the bank of corrugate. The enclosure further includes one or more vibration stabilizers to control vibrations in the corrugate bank, each of the one or more vibration stabilizers having a gusset plate joined to the cross member and extending between a pair of adjacent cooling fins and a plurality of stabilizer members each comprising a first end and a second end, wherein the first end of each of the plurality of stabilizer members is attached to the tank and the second end of each of the plurality of stabilizer members is attached to the gusset plate.

According to another embodiment of the invention, a corrugated enclosure includes a tank, a bank of corrugate affixed to one or more walls of the tank and that includes comprising a plurality of cooling fins, a cross member affixed to the bank of corrugate at an end of the cooling fins distal from the tank and along each of a top surface and a bottom surface of the bank of corrugate, and a plurality of vibration stabilizers to control vibrations in the bank of corrugate. Each vibration stabilizer further includes a gusset plate joined to the cross member and extending between a pair of adjacent cooling fins and a pair of stabilizer members attached to the tank and the gusset plate so as to be in a V-shaped arrangement.

According to yet another embodiment of the invention, a transformer includes a tank, a core-winding assembly positioned within the tank and including a transformer core and a plurality of windings wound about the transformer core, and a transformer fluid contained within the tank and immersing the core-winding assembly. The transformer also includes a corrugate bank comprising a plurality of cooling fins that are formed on one or more walls of the tank, with a cross member affixed to the bank of corrugate at an end of the cooling fins distal from the tank and along each of a top surface and a bottom surface of the bank of corrugate. The transformer further includes a plurality of vibration stabilizers to control vibrations in the corrugate bank, with each vibration stabilizer having a gusset plate joined to the cross member and extending between a pair of adjacent cooling fins of the plurality of cooling fins and a pair of stabilizer members attached to the tank on a first end of the stabilizer members and attached to the gusset plate on a second end of the stabilizer members, the pair of stabilizer members being in a V-shaped arrangement.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An enclosure for an electrical apparatus, the enclosure comprising:

a tank comprising a plurality of walls that define a tank volume capable of containing a cooling fluid therein, one or more of the plurality of walls including openings formed therein that provide an inlet and outlet for the cooling fluid;

a bank of corrugate affixed to each of the one or more of the plurality of walls that include the openings formed therein, the bank of corrugate comprising a plurality of cooling fins in fluid communication with the tank volume via the plurality of openings such that cooling fluid can flow into the plurality of cooling fins; and a cross member affixed to the bank of corrugate along each of a top surface and a bottom surface of the bank of corrugate, at an end of the cooling fins distal from the tank, with each cross member extending along a length of the bank of corrugate;

one or more vibration stabilizers configured to control vibrations in the corrugate bank, each of the one or more vibration stabilizers comprising:

a gusset plate joined to the cross member and extending between a pair of adjacent cooling fins; and a plurality of stabilizer members each comprising a first end and a second end, wherein the first end of each of the plurality of stabilizer members is attached to the tank and the second end of each of the plurality of stabilizer members is attached to the gusset plate.

2. The enclosure of claim 1 wherein the plurality of stabilizer members comprises a pair of stabilizer rods attached to the tank and the gusset plate so as to be in a V-shaped arrangement.

3. The enclosure of claim 2 wherein each of the plurality of stabilizer rods has a diameter of ⅜ inches.

4. The enclosure of claim 1 wherein each of the plurality of stabilizer members is affixed to the tank a same distance above the top surface of the bank of corrugate or below the bottom surface of the bank of corrugate.

5. The enclosure of claim 1 wherein the gusset plate includes a slot formed therein, the slot being formed in an edge of the gusset plate opposite an edge that is joined to the cross member.

6. The enclosure of claim 5 wherein the plurality of stabilizer members is affixed to the gusset plate at a location inwardly spaced from the slot, toward a center of the bank of corrugate.

7. The enclosure of claim 1 wherein the gusset plate extends between an outermost fin and a second outermost fin of the bank of corrugate.

8. The enclosure of claim 7 wherein the plurality of stabilizer members is affixed to the gusset plate at a location adjacent the second outermost fin.

9. The enclosure of claim 8 wherein the affixing of the plurality of stabilizer members to the gusset plate adjacent the second outermost fin causes a portion of vibrational forces experienced by the outermost fin to be transferred to the second outermost fin.

10. The enclosure of claim 1 wherein the bank of corrugate is composed of 16 gauge metal.

11. The enclosure of claim 1 wherein the one or more vibration stabilizers comprises a vibration stabilizer positioned proximate each of four corners of the bank of corrugate.

12. A corrugated enclosure comprising:

a tank;

a bank of corrugate affixed to one or more walls of the tank, the bank of corrugate comprising a plurality of cooling fins;

a cross member affixed to the bank of corrugate at an end of the cooling fins distal from the tank and along each of a top surface and a bottom surface of the bank of corrugate;

a plurality of vibration stabilizers to control vibrations in the bank of corrugate, each vibration stabilizer comprising:

a gusset plate joined to the cross member and extending between a pair of adjacent cooling fins; and a pair of stabilizer members attached to the tank and the gusset plate so as to be in a V-shaped arrangement.

13. The corrugated enclosure of claim 12 wherein the tank forms a volume capable of housing a cooling fluid therein, and wherein each of the one or more walls of the tank having a bank of corrugate affixed thereto includes openings formed therein that provide an inlet and outlet for the cooling fluid to flow from the volume out into the plurality of cooling fins and back to the volume.

14. The corrugated enclosure of claim 12 wherein the gusset plate includes a notch formed therein, the notch being formed in an edge of the gusset plate opposite an edge that is joined to the cross member.

15. The corrugated enclosure of claim 14 wherein the pair of stabilizer members is attached to the gusset plate at a location inwardly spaced from the notch, toward a center of the bank of corrugate.

16. The corrugated enclosure of claim 12 wherein the gusset plate is positioned between and joined to an outermost cooling fin and a second outermost cooling fin of the bank of corrugate.

17. The corrugated enclosure of claim 12 wherein each of the plurality of stabilizer members is attached to the tank a same distance above the top surface of the bank of corrugate or below the bottom surface of the bank of corrugate.

18. A transformer comprising:

a tank;

a core-winding assembly positioned within the tank and including a transformer core and a plurality of windings wound about the transformer core;

a transformer fluid contained within the tank and immersing the core-winding assembly;

a corrugate bank formed on one or more walls of the tank and comprising a plurality of cooling fins, the corrugate bank having a cross member affixed thereto at an end of the cooling fins distal from the tank and along each of a top surface and a bottom surface of the bank of corrugate; and a plurality of vibration stabilizers to control vibrations in the corrugate bank, each vibration stabilizer comprising:

a gusset plate joined to the cross member and extending between a pair of adjacent cooling fins of the plurality of cooling fins; and a pair of stabilizer members attached to the tank on a first end of the stabilizer members and attached to the gusset plate on a second end of the stabilizer members, the pair of stabilizer members being in a V-shaped arrangement.

19. The transformer of claim 18 wherein the gusset plate is positioned between and joined to an outermost cooling fin and a second outermost cooling fin of the corrugate bank.

20. The transformer of claim 19 wherein the gusset plate includes a notch formed therein, the notch being formed in an edge of the gusset plate opposite an edge that is joined to the cross member; and wherein the pair of stabilizer members is affixed to the gusset plate on a side of the notch adjacent the second outermost cooling fin.

* * * * *